United States Patent [19]

Miller, Jr. et al.

[11] 4,093,017

[45] June 6, 1978

[54] CORES FOR INVESTMENT CASTING PROCESS

[75] Inventors: John J. Miller, Jr., South Euclid; Donald L. Eppink; Ted A. Loxley, both of Mentor, all of Ohio

[73] Assignee: Sherwood Refractories, Inc., Cleveland, Ohio

[21] Appl. No.: 644,939

[22] Filed: Dec. 29, 1975

[51] Int. Cl.[2] ..... B22C 1/02; B22C 9/04; B22C 9/10; B22C 9/12

[52] U.S. Cl. ..... 164/28; 106/38.9; 164/34; 164/41; 164/121; 164/127; 164/138; 164/361; 164/369

[58] Field of Search ..... 164/28, 34, 35, 36, 164/41, 60, 61, 121, 127, 138, 369, 361; 106/38.9

[56] References Cited

U.S. PATENT DOCUMENTS

| | | | |
|---|---|---|---|
| 2,211,133 | 8/1940 | Krosta | 164/41 X |
| 3,401,738 | 9/1968 | Parille | 164/361 X |
| 3,540,519 | 11/1970 | Yates | 164/41 X |
| 3,542,120 | 11/1970 | Piearcey | 164/361 |
| 3,620,289 | 11/1971 | Phipps, Jr. | 164/60 |
| 3,643,728 | 2/1972 | Hulse | 164/369 X |
| 3,700,023 | 10/1972 | Giamei et al. | 164/60 |

*Primary Examiner*—Francis S. Husar
*Assistant Examiner*—Gus T. Hampilos
*Attorney, Agent, or Firm*—Vincent A. Greene

[57] ABSTRACT

A porous high-silica core is disclosed for use in directional solidification casting processes having exceptional thermal stability at temperatures above 1650° C. and containing mineralizers which promote the formation of cristobalite. The cores may be made by mixing at least 75 parts of essentially pure fused silica particles with 1 to 25 parts of activating particles containing a mineralizer, such as an alkali metal or alkaline earth metal compound, may be fired at a temperature of 1000° to 1300° C. until they contain 35 percent or more of cristobalite and may then be cooled to room temperature. They may thereafter be incorporated in a shell mold in accordance with the "lost-wax" process and preheated with the shell mold at a temperature of 1300° to 1600° C. to provide a cristobalite content of 60 to 85 percent or more within a short period of time, such as 10 to 30 minutes, and before a molten superalloy is allowed to flow into the mold. The core has exceptionally high thermal stability and may be maintained at a temperature of 1550° to 1600° C. or higher for one hour or more during the directional solidification process without substantial deformation. The high ultimate use temperature of the core makes it possible to produce better castings by carrying out the D.S. process at a temperature 50° to 100° centigrade higher than previously used.

12 Claims, 2 Drawing Figures

CORES FOR INVESTMENT CASTING PROCESS

BACKGROUND OF THE INVENTION

The present invention relates to special high-cristobalite refractory cores for high-temperature directional solidification casting of superalloys and more particularly to the use of high-silica cores containing mineralizers to promote rapid devitrification of the vitreous silica to cristobalite.

Turbine airfoils and various other precision metal parts are formed of special metal alloys and are manufactured by a directional solidification casting process, commonly known as the "D.S. process," in which the parts are cast from conventional nickel- and cobalt-base alloys, such as B 1900, Mar-M-200, Mar-M-509, TRW 6A and the like. In order to produce hardware with complex internal cavities, preformed ceramic cores are employed to form the cavity in the casting. These cores are porous and preferably made predominantly of silica so that they can be removed readily by leaching without damage to the casting.

The cores are formed to a predetermined size and shape by molding a refractory core composition, and the green cores are then fired at a temperature of 1000° to 1300° C. to remove combustibles and to form a porous high strength product.

The first step in the production of a hollow turbine blade or other airfoil by a typical investment casting process is to place the preformed ceramic core in a cavity die and to inject wax or other destructible pattern material around the core. Sprue components including gates, downpoles and the like are also injected and, together with the cored patterns of the part desired, are assembled into clusters. The wax assembly is then dipped in a ceramic slurry, dusted with refractory grain, and dried. These steps are repeated many times until there is formed a shell of sufficient thickness, for example, a thickness of one-fourth inch. The process of making such a shell mold is well known and is fully described in U.S. Pat. No. 2,932,864.

After the desired number of layers have been formed on the shell mold and the mold has been thoroughly dried, the wax is removed by the application of heat. Autoclave and flash fire dewaxing are the most commonly used methods. After firing and cleaning, the mold is ready for use in metal casting.

In the standard casting process the molds and consequently the cores, are preheated to at least 800° C. and the molten metal is poured into the molds at high temperatures. In the so-called "D.S. process", the molds are preheated to temperatures in the range of 1400° to 1600° C. and the metal is poured at high temperatures, such as 1500° to 1650° C.

In order for a refractory core to function acceptably in an investment casting process, an optimization of properties is required. The core composition must be suitable for economical molding and must be carefully selected so that the core is porous and can be leached out without damaging the metal casting, so that it has sufficient strength to resist the forces applied during wax injection, so that it has adequate high-temperature strength to withstand stresses due to non-uniform metal flow, so that it has dimensional stability during preheating and metal pouring, and so that it is chemically inert to the molten superalloys.

Core compositions were developed prior to the present invention which met the necessary requirements for standard investment casting. However, they were not entirely satisfactory for making cores used in the directional solidification process for casting turbine blades and vanes and other precision metal parts.

In such "D.S. process" the shell mold and its associated core can be preheated to a temperature of 1350° to 1500° C. or higher and a molten superalloy poured into the mold at a temperature of 1450° to 1600° C. The molten metal contacts a cooled chill plate, which supports the mold and the core, and the casting is progressively solidified and gradually cooled to a temperature below 1100° C. by controlling the heat and by gradually lowering the chill plate away from the upper heating zone of the furnace. A typical cycle often requires one-half hour or more so that the core can be subjected to a temperature above 1450° C. for a substantial period of time. This can cause serious sagging and distortion of a conventional porous silica core so that the necessary close tolerances cannot be maintained in the cast piece.

The refractory cores which were available prior to the present invention had poor thermal stability at high temperatures, such as 1550° C. and above, and therefore were unsatisfactory or did not permit the D.S. process to be carried out at the optimum temperature or with the desired thermal gradients.

In a typical D.S. process the porous leachable refractory core and the surrounding shell mold are preheated to a temperature of 1350° to 1500° C. for ten minutes to one hour or so before the molten superalloy is poured or allowed to flow into the mold, and this necessarily results in some shrinkage while converting some of the fused silica to cristobalite.

Heretofore, the amount of impurities in silica cores was limited to avoid contamination of the metal during casting and to avoid loss of thermal stability. Small amounts of impurities such as sodium can, for example, cause formation of low melting glasses and drastically lower the resistance of a core to sagging under heat. It is found, for example, that a few percent of a contaminating material in a core containing 95 percent or more of essentially pure fused silica can lower the temperature at which plastic flow begins by more than 50° Centrigrade.

Ordinarily, fused silica contains sodium and other normal impurities which promote devitrification, but the amounts are small and the impurities are distributed throughout the particles so that their effect is minimized. The devitrification of a conventional high-silica core proceeds at such a slow rate that the amount of cristobalite is limited and the core sags and deforms when it is used in the D.S. process for casting of superalloys. For this reason, silica cores made prior to this invention containing high percentages of silica did not have the thermal stability sought for use in the D.S. process and did not solve the sagging problem.

A satisfactory solution to the problem is not obtained by mixing silica particles with other refractories, such as alumina, because this does not produce a core with optimum refractoriness as desired in modern D.S. casting processes. The incorporation of such other refractories can limit the maximum use temperature so that the D.S. process cannot be carried out at desirable temperatures such as 1550° to 1600° C.

SUMMARY OF THE INVENTION

The present invention involves a major improvement in the art of directional solidification casting by providing a porous leachable core which can resist sagging and maintain the necessary dimensional accuracy even if held for hours at temperatures in excess of 1550° C. The porous refractory core of this invention is unique in that a substantial amount of a mineralizer is added to the refractory composition to increase the rate of devitrification and to permit conversion of 75 to 85 percent or more of the vitreous silica to cristobalite before the molten metal is poured or allowed to flow into the mold cavity.

An object of the invention is to provide a porous leachable refractory core with exceptional thermal stability which will function effectively and resist sagging and distortion when employed in the directional solidification casting process at temperatures of 1550°to 1650° C. or higher.

A further object of the invention is to provide a greatly improved D.S. process which produces hollow castings of superior quality and greater dimensional accuracy.

The present invention provides an excellent solution to the problem of sagging and distortion of the core during directional solidification casting of superalloys by employing a high percentage of high purity vitreous silica particles and a minor percentage of a mineralizer containing substantial amounts of devitrifying metallic ions which promote the formation of cristobalite. The mineralizer is distributed throughout the refractory core in such a manner that the added alkali metal compounds or other devitrifying metallic compounds do not materially reduce the thermal stability of the core or the temperature at which it begins to lose its strength and rigidity. Although the mineralizer, such as alkali or alkaline earth metal compounds, have a strong tendency to reduce the thermal stability of a pure crystalline or vitreous silica, controlling the amount and distribution of the devitrifying metallic ions will promote the rapid formation of cristobalite without materially lowering the thermal stability of the cristobalite formed.

A precision refractory core with the various properties needed for casting of superalloys by the D.S. process is produced in accordance with the present invention by providing a core composition containing a high percentage of silica, preferably at least 90 or 95 percent by weight, and containing a minor amount, such as 5 to 20 percent by weight, of activating refractory particles of small particle size, preferably 50 microns or less which contain effective amounts of devitrifying ions of alkali or alkaline earth metals or other devitrifying metals. The activating particles, which function as a mineralizer, may be an alkali metal silicate or a refractory, preferably silica but also zircon, zirconia or alumina, which contain a minor amount of the devitrifying metallic ions. The devitrifying metal is preferably an alkali metal, such as sodium or lithium, and is preferably present in the core composition in an amount from about 0.02 to about 0.2 percent by weight.

The major portion of the refractory particles in the core body must have a high purity so that they will resist melting and retain strength at temperatures encountered during the D.S. process and so that the core will maintain the needed porosity and leachability. The activating mineralizer particles should also have a relatively high purity for the same reason but contain substantial amounts of the devitrifying metallic ions, such as 0.2 percent by weight or higher, and preferably several times the amounts present in the high-purity refractory particles.

In a conventional process prior to this invention, a core composition containing silica particles and a suitable binder was molded to form a porous core, the core was fired at a temperature of 1000° C. or more and then cooled to room temperature, thereafter a wax pattern was formed around the core and the pattern and core were repeatedly coated with a refractory slurry and dried to form a multi-layer shell mold, the wax pattern was removed, the shell mold was fired, and the shell mold and core were preheated at a temperature from 1300° to 1500° C. for 10 minutes to 1 hour before the molten metal was allowed to flow into the mold and around the core. Such preheating inherently caused formation of cristobalite but the rate of cristobalite formation was low. If a molten superalloy at a temperature of 1600° to 1650° C. was poured into the mold and allowed to flow around a conventional high-silica core maintained at a temperature such as 1400° to 1550° C. the core would deform or sag because of poor thermal stability. Therefore, the D.S. process was temperature limited.

The present invention solves the problem by incorporating mineralizer particles in the core composition so that the cristobalite content is at least 60 percent by weight at the time metal pouring or casting is initiated. This is preferably accomplished in the basic process described above by incorporating a substantial amount, such as 0.03 to 0.2 percent by weight, of devitrifying metallic ions in the core. In the preferred process the green molded core is fired at a temperature of 1000° to 1400° C. for a period of time sufficient to provide 40 to 55 percent by weight of cristobalite and is then cooled to a temperature below 100° C. while maintaining a modulus of rupture of at least 700 and preferably 800 to 1000 pounds per square inch or higher.

After the core has been located in the shell mold, the core and the mold are preheated for a period of time up to 1 hour at a temperature of 1300° to 1600° C. to provide a high cristobalite content which, in accordance with the present invention, is at least 60 percent and more preferably at least 80 percent by weight before the molten metal is poured or allowed to flow around the core. The maximum amount of cristobalite will depend upon the amount of zircon, zirconia, or other refractory included in the core. It is generally preferable to provide enough mineralizer in the core so that at least 75 percent by weight of the silica is converted to cristobalite before metal pouring is initiated.

The present invention provides porous leachable cores with outstanding resistance to sagging and deformation at high temperature and make it possible to carry out the D.S. process while maintaining the molten metal at temperatures of 1550° to 1600° C. or higher for extended periods of time. A high silica core made according to this invention has excellent thermal stability and can be compounded and treated so that it will maintain strength and rigidity at temperatures of 1600° to 1650° C. or more approaching the melting point of cristobalite.

DESCRIPTION OF THE PREFERRED EMBODIMENTS

The present invention is particularly concerned with the manufacture of precision hollow metal parts by the directional solidification (D.S.) process and the use of precision porous refractory cores designed to withstand severe conditions such as encountered in that process. The core must have a high thermal stability and excellent strength as well as high porosity and contains a high percentage of silica and an effective amount of activating mineralizer particles which promote devitrification.

The term "mineralizer" is well known in ceramics and refers to substances such as alkalies and alkaline earths and other various substances and mixtures which promote the conversion of one phase of silica into another, such as the conversion of vitreous silica to crystalline silica.

The term "activating particles" as used in the specification and claims refers to particles which contain devitrifying metallic ions and which function as mineralizers in the refractory body.

The term "devitrifying metallic ion" as used herein applies to ions or atoms of metals such as alkali or alkaline earth metals or the like which cause the silica to devitrify and to form cristobalite at a substantial rate. Such term excludes aluminum or metals less effective than aluminum in promoting devitrification. The devitrifying metals suitable for use in the present invention are described in more detail hereinafter.

The present invention is applicable to the manufacture of porous refractory cores or mold parts of various configurations. It is particularly well suited to the production of cores for turbine blades, compressor blades, or other airfoils, jet engine parts and other precision parts made of nickel- and cobalt-base superalloys.

Figure 1:
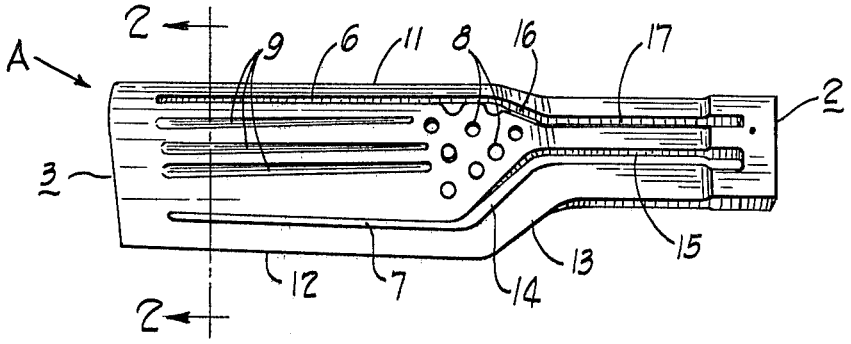
FIG. 1 is a perspective view showing a porous turbine blade core which may be made according to the invention.
Figure 2:
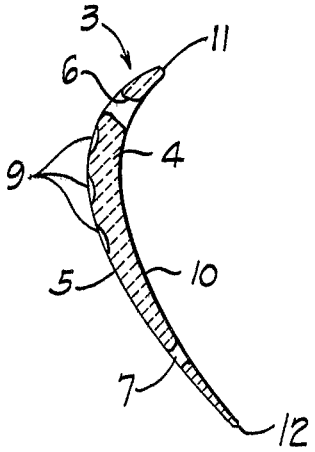
FIG. 2 is a sectional view of the core of FIG. 1 on a larger scale.

A turbine blade core usually has a curved cross section and may have a shape generally as indicated in FIGS. 1 and 2. The core is shown for purposes of illustration rather than limitation, it being understood that the core may be of any desired size or shape.

As herein shown, the molded refractory core A has a flat rectangular section 2 integrally joined to a curved airfoil section 3 of greater width. The portion 3 has a thick leading edge portion 4 and gradually decreases in thickness to the trailing edge portion 5, which is inclined at a substantial angle relative to section 2.

As shown, the core has slots 6 and 7 near the leading and trailing portions of the core and has a series of regularly spaced circular holes 8 near the central portion of the core. The upper surface of the core has a plurality of straight parallel grooves 9 which extend outwardly from holes 8. The core has a smooth curved bottom surface 10 and straight leading and trailing edges 11 and 12 at opposite sides of surface 10. The curved trailing edge portion 13 extends inwardly from trailing edge 12 to the trailing edge of section 2, and the slot 7 has an inclined portion 14 which extends generally in the same direction to the straight portion 15 of the slot located in section 2. The slot 6 has an inclined portion 16 and a straight portion 17 located in the section 2 parallel to the slot portion 15. It will be understood that the arrangement of the slots or other openings in the core will vary according to the intended use and that a multitude of different core configurations can be employed.

A core of any suitable configuration may be formed in accordance with this invention and used in the D.S. process for casting metal parts. It may be located in a shell mold made by the "lost-wax" process or in any other suitable refractory mold and may be preheated with the mold in any suitable apparatus. The D.S. process may be carried out with or without a vacuum. If the process is carried out in a vacuum furnace, the mold and core may be preheated inside the enclosing walls of the furnace.

The equipment used to carry out the D.S. process may be conventional and forms no part of this invention. It may, for example, be of the type illustrated in U.S. Pat. No. 3,620,289, U.S. Pat. No. 3,690,367 or U.S. Pat. No. 3,700,023. Whether or not the casting is maintained under vacuum during solidification, the preferred procedure is to gradually lower the chill plate supporting the shell mold from the heating zone, which may be surrounded by a graphite sleeve and heated by stationary induction heating coils as shown, for example, in U.S. Pat. No. 3,700,023.

In carrying out the process of the present invention, the first step is to prepare a core composition which will devitrify in the desired manner and which is capable of providing a porous refractory core having the necessary refractoriness or thermal stability. The cores made according to this invention are in many ways similar in composition to conventional high silica cores used in investment casting of precision metal parts, but they are unique and revolutionary in the field of directional solidification casting in that they maintain close tolerances and permit use of molten metal casting temperatures much higher than anything which could be tolerated by refractory cores made prior to the invention.

Core compositions made according to this invention are unusual in that they employ high percentages of silica of high purity to avoid loss of refractoriness due to the presence of other refractory materials or impurities, such as alkali metal compounds or the like which tend to form low-melting compounds and in that they have added thereto a mineralizer containing predetermined amounts of these same impurities. Although these compositions are unusual, they should in many ways be similar to conventional core compositions as indicated below.

The preformed refractory cores of the present invention must be leachable in caustic to permit removal of the core without serious damage to the metal casting and, therefore, must have a suitable porosity, such as 20 to 40 volume percent, and must contain at least 70 percent by weight of silica. The porosity is preferably at least 25 volume percent.

The core of the present invention must also have good refractoriness and thermal stability so that it will retain rigidity and will not slump or deform substantially when in contact with a molten superalloy at a high temperature, such as 1500° or 1600° C. Therefore, the core preferably contains at least 90 and more preferably at least 95 percent by weight of silica, but zircon and zirconia can be tolerated in substantial amounts because they have less tendency to reduce refractoriness than alumina and other metal oxides. Generally a fired core made according to this invention should contain at least 70 and preferably 75 to 99.9 percent by weight of silica with a purity of at least 99 percent by weight, up to 30 and preferably no more than 25 percent by weight of zircon and zirconia, up to 5 and preferably less than 2 or 3 percent by weight of alumina, and no more than 10 and preferably less than 5 percent by weight of other high temperature refractories, and such core preferably contains no more than 10 and more preferably no more than 5 percent by weight of refractories other than silica, zircon and zirconia.

If the core contains a small amount, such as 5 to 10 percent by weight, of a refractory other than silica, such refractory is preferably zircon or zirconia. The latter can facilitate X-ray inspection of the leached metal castings.

When it is desired to provide maximum refractoriness, the amount of silica is preferably 98 to 99.5 percent or higher and the core is compounded to provide a very high amount of cristobalite prior to metal pouring, such as 85 to 95 percent or higher. The present invention makes it possible to provide a high-silica core which retains rigidity and resists slumping during metal casting at high temperatures, such as 1650° to 1680° C. or more, approaching the melting point of cristobalite.

The refractoriness or thermal stability of a core material may readily be determined by a simple slump test wherein a bar of a standard size, such as ⅛ inch by ¾ inch by 6 inches, is stood on end in an upstanding vertical position and gradually heated until it sags and deforms under its own weight. The term "ultimate use temperature" is used in the specification and claims hereof to indicate the highest temperature at which such test bar possesses rigidity and is able to support its weight and to maintain its shape in the aforesaid upstanding vertical position.

The ultimate use temperature of a core material made according to this invention and comprising at least 95 percent silica as described above is at least 1650° C. If the core material contains 25 percent by weight of zircon and 75 percent by weight of silica, its ultimate use temperature would be lower but could be substantially in excess of 1600° C. However, the ultimate use temperature drops substantially if the core material includes several percent by weight of alumina. For example, a commercial refractory core used for directional solidification casting and containing at least 95 percent silica and at least about 3 percent alumina has an ultimate use temperature of around 1560° C. and can be used at temperatures, such as 1500° C., but is unsatisfactory for casting at temperatures above 1550° C. Apparently it would be impossible to produce a core with an ultimate use temperature of 1600° C. or above if the core contains a substantial amount, such as 5 parts by weight or more, of alumina, and the same is true of many other refractories.

It is thus seen that an important feature of the invention is the use of high percentages of silica and the proper selection of refractories so that a very high ultimate use temperature can be achieved. A drastic lowering of the ultimate use temperature will result if the fused silica and other refractory material used to form the core contains substantial amounts of impurities, particularly impurities which promote the formation of low-melting glasses, such as alkali metal compounds. Because the loss of refractoriness can be catastrophic, it is essential that the amount of impurities be limited, and it is preferable not to employ less pure materials, such as 96 percent silica glasses, although a very small amount of the latter can sometimes be tolerated. Generally the silica used in the practice of this invention should have a purity of at least 99 percent and a major portion by weight preferably has a purity of at least 99.5 percent where a high ultimate use temperature is desired.

In order to avoid loss of refractoriness due to impurities, it has been common practice to form refractory cores from fused silica particles having a high purity, such as 99.5 percent or better, and containing relatively small amounts of alkali metal or alkaline earth metal compounds (for example, less than 100 parts per million of alkali metals and less than 400 parts per million of alkaline earth metals). It has not been difficult to maintain the desired high purity because commercial fused silica commonly has a purity of 99.7 to 99.8 percent or better.

As used herein, the term "high purity" refers to silica having a purity of at least 99.5 percent by weight, and the term "essentially pure" refers to silica having a purity of at least about 99.95 percent by weight. The latter can, of course, contain 20 to 50 parts per million or more of alkali metal ions plus other normal impurities.

It will be understood that the percentages of metal impurities or metallic ions as set forth in the specification and claims are in all cases based on the weight of the metal element and not the oxide of that element. Thus a core containing a given percentage or a given number of parts per million of sodium, for example, is analyzed on the basis of elemental sodium. All percentages are by weight.

The core composition employed in the practice of this invention is unique in that it contains a substantial amount of a mineralizer which is added to the high purity fused silica particles to provide a predetermined limited amount of devitrifying metal atoms or ions from Groups IA and/or IIA of the Periodic Table (as set forth by E. H. Sargent & Co. in 1962) which promote the formation of cristobalite. The amount and type of mineralizer are carefully selected to avoid a drastic loss of refractoriness and to provide a core which can be readily converted to cristobalite and which has a high ultimate use temperature, such as 1650° C. or higher.

A large number of different mineralizers can be employed in the practice of the present invention. The mineralizer preferably provides devitrifying ions of alkali metals, such as potassium, sodium or lithium, or alkaline earth metals, such as barium, calcium or magnesium. Sodium ions are preferred because of a higher rate of diffusion. The mineralizer may be a salt, an oxide, a silicate, a nitrate, a borate or other compound of such alkali metal or alkaline earth metal including sodium acetate, sodium chloride, sodium carbonate, sodium silicate, lithium silicate, potassium silicate, magnesium silicate, borax, baking soda, or the like or a mixture of different mineralizers. Best results are achieved where the mineralizer comprises treated particles of fused silica or other suitable refractory having a small particle size and containing devitrifying metallic ions concentrated near the surfaces of the particles. The mineralizer is preferably colloidal silica or a silica-producing material containing the devitrifying metallic ions so that the resulting fired core contains a very high percentage of silica.

An excellent mineralizer is a commercial sodium-stabilized colloidal silica sold under various trade names such as "Ludox", "Syton" or "Nalcoag". The preferred mineralizers are particles of fused silica or other suitable refractory particles treated with an alkali metal compound or alkaline earth compound to provide cristobalite promoting metallic ions concentrated near the outer surfaces of the particles. For example, such ions may be so concentrated in the treated particles that a majority of the devitrifying metallic ions in an average particle are located in the outer third of the particle or near the outer surface of the particle.

Good results can also be obtained when the mineralizer is a silicate of a metal in Group IA or IIA of the Periodic Table. The preferred silicates are alkali metal silicates, such as a sodium silicate, and these should have a particle size no greater than 100 microns and preferably no greater than 50 microns when added to the core composition. The alkali metal silicate may be made in any suitable manner and may have an $SiO_2/M_2O$ mol ratio of from 1.2:1 to 4:1 as disclosed for example in U.S. Pat. No. 3,918,921.

The mineralizer may be incorporated in a core in various ways. It is preferably mixed with the high-purity fused silica particles of the core composition prior to molding but can sometimes be applied by impregnating the porous core with a solution of the mineralizer. The core formulation and the amount and type of mineralizer used depends on the method used to make the core.

Various conventional molding methods may be used to make the cores including pressing, injection, transfer, slip casting, dip casting, extruding and the like and various drying and firing procedures may be employed. In general, it is preferred to employ a core composition containing an organic binder in addition to the refractory particles, and a high-temperature binder may also be employed. An organic vehicle or a wax may be incorporated in the core composition and various other materials may be included, such as a mold release agent or an internal lubricant, as are employed in conventional core compositions. The amounts of the various binders and the particle sizes of the refractory are selected to provide the fired core with a suitable porosity and the desired physical properties. Generally a core composition will contain from about 5 to 15 percent by weight of an organic binder, but this can vary substantially. The binder can, for example, be a wax, an ethyl silicate, an organic resin, or various other binders commonly used in core compositions. The binder can be an organic polymer, such as polyethylene or polypropylene. Suitable binders and other additives are disclosed, for example, in U.S. Pat. Nos. 3,093,494; 3,222,435; 3,325,571; 3,330,892; 3,423,216; 3,549,736; 3,688,832 and 3,769,044.

If the core is originally formed with a very high porosity, it is possible to apply a substantial amount of a mineralizer by impregnating the porous core with the mineralizer. It is preferable not to apply the mineralizer by impregnating the core for various reasons. Such a method tends to produce non-uniform and unpredictable results and often requires use of excess mineralizer to offset losses due to evaporation, particularly when the core is treated with an alkali metal salt or the like. Superior results are obtained when the mineralizer is present in the original core composition and is thoroughly and uniformly mixed with fused silica particles, and best results are obtained when the mineralizer of the core composition comprises treated refractory particles, such as fused silica particles.

The amount of mineralizer employed in the core composition according to this invention depends on the type of mineralizer and on the amount of devitrifying metallic ions lost by evaporation during firing of the core. If the mineralizer is a sodium silicate containing, for example, 20 or 30 percent by weight of sodium, then the amount needed may be only 0.5 to 2 percent by weight. If the mineralizer comprises activating refractory particles, such as dried sodium-stabilized colloidal silica, a larger amount would be preferred. Generally the mineralizer comprises 1 to 25 percent of the weight of the core.

In determining the optinum amount of the mineralizer, the important thing is the amount of devitrifying metallic ions retained in the core after firing, and the percentages of such ions are set forth in that manner in the specification and claims hereof, but it will be understood that substantial amounts of mineralizer may be required to offset losses due to evaporation when using less desirable mineralizers, such as sodium salts or the like.

In carrying out this invention, the total amount of devitrifying metallic ions provided in the fired core by the mineralizer is preferably 0.02 to 0.1 percent by weight and could be 0.2 percent or more. Such amount is more preferably at least 0.03 percent by weight, and the total amount of devitrifying metallic ions in the fired core is preferably at least 0.04 percent and preferably such that the core retains a high ultimate use temperature, such as 1650° C. or higher. For example, good results can be obtained when the mineralizer provides the core (after firing) with 0.02 or 0.03 to 0.2 percent by weight of devitrifying ions of metals in Groups IA and IIA of the Periodic Table or when the total amount of such ions in the fired core is in the range of 0.02 to 0.2 percent.

The percentage of devitrifying metallic ions in the mineralizer is much greater than the percentage of such ions in the fused silica particles of the core composition. The mineralizer used in the core composition preferably contains 0.1 to 1 percent or more and more preferably at least 0.2 percent by weight of the devitrifying metallic ions, and the total weight of such ions in the core composition is greater than and preferably at least several times the total weight of the devitrifying metallic ions of the high purity silica particles. For example, the alkali metal content of the high-purity silica particles may be less than 0.01 percent.

The amount of the devitrifying ions provided depends on the type of metal involved. If the mineralizer provides sodium ions, the preferred total amount of sodium in the fired core would be 0.03 to 0.1 percent. If the mineralizer provides lithium or potassium ions, rather than sodium ions, then the preferred total amount of lithium or potassium in the fired core would be 0.04 to 0.2 percent. Larger amounts of magnesium ions could be tolerated such as 0.1 or 0.3 percent or higher.

A major portion by weight of the devitrifying metallic ions of the core (after firing) are preferably provided by the added mineralizer and no more than a minor portion should be present as natural impurities in the silica. The natural impurities, such as sodium which are present in the fused silica particles tend to promote devitrification but are less effective than the ions provided by the mineralizer and are undesirable in substantial amounts in that they lower the ultimate use temperature. Best results are obtained where the refractory particles, other than the mineralizer, have a high purity such as 99.5 percent or better or more preferably at least 99.75 percent.

The refractory particles of the preferred core compositions made according to this invention comprise 75 to 99 percent by weight of high purity silica particles with a purity of at least 99.5 percent and 1 to 25 percent by weight of refractory mineralizer particles containing at least 0.1 and preferably at least 0.2 percent by weight of devitrifying metallic ions which promote the formation of cristobalite. The percentage by weight of said metallic ions in said refractory mineralizer particles is preferably several times and more preferably at least four times that in said high purity silica particles. Said mineralizer particles are preferably fused silica particles or other refractory particles with a particle size less than 100 and preferably not in excess of 50 microns.

The refractory particles used in the core compositions of this invention may have a particle size as is employed in conventional core compositions. For optimum density, the largest fused silica particles are preferably 200 Tyler mesh or about 75 microns but a small percentage could be 150 microns or larger. The particle size depends to some extent on the type of binder and the type of molding method employed. If the core is to be made by slip casting, the largest particles should be under 50 microns and preferably below 25 microns and a majority of the particles should be no larger than 325 Tyler mesh. If the core is to be molded by injection molding, a major portion by weight of the refractory particles of the core composition preferably has a particle size from 35 to 100 microns and a minor portion has a smaller particle size.

In the practice of the present invention, excellent results can be obtained if the refractory particles of the core composition comprise at least 40 and preferably 50 to 85 percent by weight of particles with a particle size of 35 to 100 microns and 15 to 50 percent or more of particles with a particle size no more than 30 or 40 microns.

Half of the latter particles could, for example, be activating mineralizer particles as described previously. The particle size of the mineralizer particles is preferably no more than 30 or 40 microns and the average particle size can be 1 to 20 microns.

If fused silica particles and mineralizer particles of the proper particle size and proper purity are employed in the core composition, the proper porosity can be obtained in the fired core and the devitrifying material can be distributed in the core in such a way that the core does not deform at high metal casting temperatures. For example, excellent results can be obtained where the refractory particles of the core composition comprise 80 to 98 percent by weight of fused silica particles with a purity of at least 99.5 percent by weight and 2 to 20 percent by weight of activating mineralizer particles with a particle size not in excess of 50 microns containing at least 0.2 percent by weight of devitrifying metallic ions, such as sodium ions.

If the mineralizer comprises dried sodium-stabilized colloidal silica particles, the fired core can contain 98 percent by weight or more of silica and can have an ultimate use temperature in excess of 1650° C. The latter core can contain a major portion by weight of cristobalite after the initial firing and cooling and still have a high modulus of rupture such as 800 or 900 pounds per square inch. However, the fracturing of the cristobalite which results each time the core is cooled below the alpha-beta inversion temperature or below 200° C. can lower the strength of the core materially.

When it is desired to form a core containing 98 percent or more by weight of silica, the core composition can contain silica-forming materials as well as the fused silica particles. Various silica-forming materials may be employed including liquid thermosetting phenyl lower alkyl siloxane resins of the general type disclosed in U.S. Pat. No. 3,108,985 and U.S. Pat. No. 3,126,357. These are well known in the art and may be converted to silica upon heating of the core to a temperature above 1000° C.

It will be understood that some of the advantages of this invention can be obtained even if the core composition contains refractories or impurities in amounts which lower the ultimate use temperature somewhat below 1600° C. Various refractories other than silica, alumina, zircon or zirconia can be employed in small amounts, such as 10 percent by weight or less. Other refractories which might be included in the core composition include magnesium oxide, calcium oxide, barium oxide, thoria, strontium oxide, beryllium oxide, silicon carbide, silicon nitride, yittria, nickel oxide and others having a melting point higher than that of silica. Generally it is desirable to avoid use of significant amounts of these refractories.

The amount of impurities present in the fused silica particles of the core composition depend on the manufacturer and on the grade of the silica. It is not difficult to find commercial fused silica suitable for use in cores of the present invention which are to be used in the directional solidification process, for example. The fused silica for such D.S. cores preferably contains less than 10 parts per million of the most undesirable elements, such as bismuth, silver, cadmium and antimony, and less than 150 parts per million of highly undesirably elements, such as lead, tin and zinc.

For example, a suitable fused silica could produce a D.S. core containing less than 1 part of bismuth, less than 1 part of silver, less than 1 part of cadminum, less than 5 parts of antimony, less than 40 parts of tin, less than 40 parts of lead, less than 60 parts of zinc, and less than 2000 parts of alkali and alkaline earth metals per million parts by weight of refractory material. The latter core could, for example, also contain up to 1000 parts of iron, up to 1000 parts of aluminum, up to 1000 parts of titanium and hafnium, and up to 400 parts of other metals, such as nickel, manganese, chromium, strontium or copper, per million parts of refractory. The unwanted metallic impurities are preferably present in small amounts as natural impurities, but it will be understood that a satisfactory core can be made containing relatively large amounts of oxides of aluminum, iron, calcium, magnesium, hafnium, or titanium. A fused silica often contains 2000 parts per million or more of aluminum, and satisfactory results can be obtained when the core compositions employed in the practice of this invention contain 1 percent or more of alumina. Acceptable cores can be made when the total amount of iron, titanium, halfnium, magnesium and calcium in the refractory material of the core composition is in the range of 1000 to 3000 parts per million or higher, but such amount is preferably less than 2000 parts per million.

As pointed out previously, a major portion of the refractory material of the core composition is preferably a fused silica of a relatively high purity, such as 99.5 percent or better. A fused silica used in the core composition could, for example, contain as natural impurities up to 2000 parts of aluminum, up to 1000 parts of titanium, up to 1000 parts of hafnium, up to 1000 parts of iron, up to 1000 parts of magnesium and calcium, and up to 300 parts of sodium, potassium and lithium per million parts by weight of silica.

A typical high-purity fused silica would probably contain less than 100 parts per million of alkali metals and less than 500 parts per million of alkaline earth metals as natural impurities. Such fused silica is preferred for used in the core compositions because it provides the core with better refractoriness than can be obtained with a silica containing larger amounts of devitrifying metallic ions. However, it will be understood that advantages of the invention may be obtained with fused silica of much lower purity.

The core of this invention is molded or shaped after the core composition has been mixed to provide proper distribution of the mineralizer. The core can be formed by slip casting or other methods previously mentioned but is preferably made by injection molding or transfer molding. The type of binder used in the core composition will depend on the type of molding method. While the binder can be an organic compound, such as a wax, a low melting gum, ethyl cellulose, polystyrene, polyvinyl acetate, polyterpene resins, polymerized resins, linseed oil, shellac, gilsonite or the like, the binder commonly preferred for injection or transfer molding is a compound such as an ethyl silicate or a silicone or other compound which will form silica or a silicate when thermally decomposed.

In carrying out the process of the present invention, the core is molded or shaped in any suitable manner and is then carefully fired to eliminate combustibles. The green core is preferably first fired up about 500° to 600° C. to remove the organic compounds and then fired at a temperature of 1000° to 1400° C. and more preferably 1100° to 1200° C. for a period of time, such as ½ to 8 hours and preferably no more than 12 hours, sufficient to obtain the desired amount of cristobalite. The amount of devitrification should be limited so that the fired core retains adequate strength for handling after it is cooled to room temperature and should be sufficient to enable the core to form the desired amount of cristobalite during the preheat prior to metal casting (for example, at least 60 percent of cristobalite at the end of a half hour preheat).

In the preferred embodiment of this invention the green core is fired as indicated above for a period of time sufficient to obtain 35 to 60 percent by weight of cristobalite and preferably 40 to 55 percent by weight (more preferably 40 to 50 percent).

After firing is completed, the core is cooled or allowed to cool below 200° C. and below the alpha-beta inversion temperature to a temperature where the core may be maintained during storage (i.e., to room temperature or below 100° C.). As a result of the cooling, fissures develop and the core loses strength, but the core retains adequate strength for subsequent handling. After cooling to room temperature (i.e., 25° C.) the core has a modulus of rupture of at least 700 and preferably 800 to 1000 pounds per square inch or higher to provide adequate strength for wax injection. In some cases the cores can be used even if the modulus of rupture is only 500 pounds per square inch.

The core composition and the firing procedure are controlled to provide a core of the desired density and size and can be regulated to maintain very close tolerances when the core is formed by injection molding, for example. The shrinkage is below 3 percent and usually well below 2 percent during firing. The core composition is selected to provide the core with a porosity of 20 to 40 volume percent and preferably at least 25 volume percent after firing so that the core is readily leachable in caustic.

The firing of the green core results in evaporation or loss of some of the mineralizer and can, for example, result in a substantial loss of sodium ions, particularly when the mineralizer is a sodium salt or the like. The amount of mineralizer is selected so that, after firing, the core contains the desired amount of devitrifying metallic ions (for example, at least 0.02 percent and preferably at least 0.03 percent by weight).

As previously described, the fired core of the present invention should be chemically inert to molten superalloys and preferably contains at least 95 percent by weight of silica or an amount such that the core retains its rigidity at a temperature of 1600° C. and more preferably 1650° C.

The fired cores of the present invention can be stored at room temperature for long periods of time before use. They usually contain at least 40 percent by weight of alpha cristobalite which is converted to beta cristobalite when the cores are again heated above 300° C.

Before each core is used for metal casting it is located in a predetermined position inside of an outer refractory mold. The outer mold may be formed by any suitable shaping or molding process and is preferably formed of finely divided refractory particles, such as finely divided silica, zircon or alumina. The outer mold is preferably a refractory shell mold and is preferably formed around a destructible pattern made of wax, frozen mercury or other destructible material. Such pattern can, for example, be molded around the core and then repeatedly dipped in a ceramic slurry to build up a conventional multi-layer shell mold.

In the practice of the present invention the fired silica cores are preferably employed in a conventional "lost-wax" process generally as disclosed in U.S. Pat. No. 2,961,751 or U.S. Pat. No. 2,932,864. In such process the core (for example, a core of the type shown in FIGS. 1 and 2) is placed in a cavity die and wax or other destructible pattern material is injected around the core. Sprue components are also injected and together with the wax patterns may be assembled into clusters. The wax assembly including the silica cores of this invention is then dipped in a ceramic slurry, dusted with refractory grains, and dried as disclosed, for example, in said U.S. Pat. No. 2,932,864. As explained in that patent, these steps are repeated 4 to 10 times or more to form a multilayer shell mold of the desired wall thickness. The assembly including the mold, core and pattern is then thoroughly dried and the wax or other pattern material is removed. Autoclave and flash fire dewaxing are the most commonly used methods.

After dewaxing or pattern removal, the shell mold and the enclosed core can be fired in the conventional manner to provide the shell mold with the necessary strength. For example, they can be fired for 10 minutes to 1 hour at a temperature from 800° to 1100° C. The firing can be in the same furnace used for dewaxing and can be a continuation of the heating since there is no need to interrupt the heating or to remove the shell mold from the furnace.

After firing the shell mold and core must be cooled below 100° C. for inspection and handling, and they are stored at room temperature for a period of time before being used in the D.S. casting process. Thus the core is again subjected to the damaging volumetric expansion as it passes through the alpha-beta inversion temperature.

The shell mold may be made of various refractory materials as disclosed in said U.S. Pat. No. 2,932,864 including the oxides and siicates of aluminum and zirconium. The preferred refractory is alumina, and it is preferable in the D.S. process to provide a shell mold containing at least 85 percent and more preferably at least 95 percent by weight of alumina and having very high refractoriness so that it retains its shape at a temperature of 1650° to 1750° C. This permits use of very high metal casting temperatures as explained in more detail hereinafter.

The present invention provides a porous preformed high-silica core of exceptional refractoriness which may contain 90 to 99.9 parts of silica per 100 parts by weight of refractory material including 35 to 60 parts of cristobalite and 65 to 30 parts of vitreous silica. In the practice of this invention, a major portion by weight of the refractory material of the core should be converted to cristobalite before molten metal is allowed to contact or flow around the core. If the core is used in the D.S. process for casting superalloys, the cristobalite content should be at least 60 percent by weight and is preferably 80 to 100 percent by weight before molten metal is poured into the shell mold or allowed to flow around the core.

In order to provide the desired cristobalite content prior to metal casting, it is desirable to preheat the core and the surrounding shell mold for up to 1 hour and preferably no more than 30 minutes at a high temperature, such as 1300° to 1600° C., just prior to metal pouring. The preheat temperature is preferably about 1400° C. to about 1550° C., the preheat time is preferably about 10 to 30 minutes, and the core is preferably of such composition as to convert at least 75 to 80 percent by weight of the silica to cristobalite in that period of time before the molten metal is allowed to flow around the core.

It will be understood that the preheat time is usually measured from the time the D.S. furnace reaches the desired control temperature until the molten metal is poured into the mold, but that it can also be measured from the time heating of the mold in the furnace is initiated until the superalloy reaches the molten state and begins to flow over the core. The latter measurement applies when the solid superalloy is placed in or adjacent to the mold and heated with the mold to the molten state until it flows around the core to fill the mold cavity. In the latter case, there is no separate pouring step as in the more common method.

The core of the present invention can contain varying amounts of mineralizer and varying amounts of cristobalite before the aforesaid preheating step is initiated, and the rate of cristobalite formation can vary substantially, but such rate should be high to provide adequate strength when the metal is poured at a high temperature, such as 1600° C. or higher. Generally a core should be of such composition at the beginning of the preheat that at least 75 percent by weight of the silica is converted to cristobalite after preheating the core for 1 hour at 1400° C., and it is preferably of such composition that the core contains at least 60 percent by weight of cristobalite after it is preheated for ½ hour at 1400° C.

If the fired core contains a minor portion of cristobalite, such as 35 percent by weight or less, at the beginning of the D.S. preheat, it should contain enough mineralizer to provide a high rate of cristobalite formation. For example, such a core should contain a major portion of cristobalite, such as 60 to 80 percent by weight, after preheating for ½ hour at 1400° to 1600° C. and before the molten metal is allowed to contact or flow around the core.

It is important in the commercial process to provide generally uniform or reproducible results and to provide the cores consistently with substantially the same composition, substantially the same amount of cristobalite, and substantially the same percentage of the devitrifying metallic ions (i.e., 0.02 to 0.2 percent by weight analyzed on the basis of the metal element) at the time the molten metal is allowed to flow into the mold cavity. Because of this and the need for a high ultimate use temperature, the refractory particles of the core composition should have a high purity or a uniform composition, and a predetermined amount of mineralizer should be added thereto to provide most of the needed devitrifying metallic ions. The use of refractory material of varying purity levels which sometimes contains enough alkali metal ions to provide a high devitrification rate is not an acceptable process. The process of this invention is characterized by repeated use of preformed porous refractory cores of essentially the same characteristics which can consistently produce acceptable metal castings.

While the cores of this invention are well suited for metal casting at any temperature, they are especially designed for casting of superalloys at very high temperatures. They may be called D.S. cores since they are particularly suited for use in the directional solidification process and they provide excellent results when the D.S. process is carried on in a conventional manner, for example using procedures generally as described in U.S. Pat. No. 3,620,289, U.S. Pat. No. 3,690,267 or U.S. Pat. No. 3,700,023 to provide controlled orientation of the crystalline structure of the metal casting.

The present invention may be practiced using a conventional D.S. process wherein the core is located within an outer refractory shell mold to define an open-ended mold cavity of a predetermined size and shape and the mold is supported in a furnace on a chill plate at the bottom of said cavity and preheated for a suitable period of time before the molten metal is allowed to flow around or against the core. The furnace may be of the type disclosed in the above patents and preferably has a chill plate mounted to move vertically in the furnace and induction heating means, such as disclosed in said U.S. Pat. No. 3,700,023. The furnace should provide an inert atmosphere or a high vacuum, best results being obtained when casting in a vacuum.

In the conventional D.S. process, the shell mold and core are preheated to a high temperature, such as 1400° to 1500° C. for 10 to 40 minutes or so and the molten superalloy is then poured or allowed to flow into the mold cavity. If the metal is poured, it can be poured into the mold at a temperature in excess of the ultimate use temperature of the core and allowed to cool rapidly below the latter temperature. Thus the pouring temperature can sometimes be in excess of 1600° C when the ultimate use temperature of the core is below 1550° C.

After pouring, the temperature of the metal is closely controlled while the chill plate is gradually lowered in the conventional manner at a slow rate, such as 6 inches per hour to cause progressive solidification in an upward direction. Portions of the metal in the upper part of the mold cavity are maintained at temperatures above the melting point of the superalloy, such as 1400° to 1500° C., for periods of time generally in excess of 15 minutes and usually for 20 to 60 minutes or more. The solidification of the casting usually takes at least ½ hour and can sometimes take 1 hour to 1.5 hours before the shell mold and the solidified castings are removed from the furnace.

After the shell mold is removed from the furnace it can be broken away from the casting, and the porous core remaining in the casting can be removed by leaching. Leaching may be carried out in an autoclave using a 30 to 40 percent aqueous solution of sodium hydroxide at a temperature, such as 150° to 200° C.

Because the core of this invention contains a large percentage of cristobalite at the time the molten metal begins to flow against and around the core, it can resist sagging or deformation when the D.S. process is carried out at high temperatures. The cores therefore make it possible to produce castings to close tolerances with high dimensional accuracy.

Prior to this invention, the preformed porous refractory cores used in the D.S. process commonly had ultimate use temperatures below 1550° C. With some superalloys it was desirable to carry out the metal casting at temperatures in excess of 1500° C. which caused the core to sag and deform.

As the metal casting temperature is increased a point is reached where all of the castings are defective because of slumping or sagging of the core. At a somewhat lower temperature it is possible to produce some acceptable metal castings even if a major portion of the castings are defective. On this basis it has been possible to carry on D.S. metal casting at temperatures in excess of 1500° C. using cores with an ultimate use temperature of less than 1550° C.

In accordance with one embodiment of the present invention, the shell mold is formed of a refractory material, such as alumina, which provides the mold with an ultimate use temperature in excess of 1650° C., and the preformed silica core is formed of at least 95 percent by weight of silica and is provided with an ultimate use temperature of 1650° to 1680° C. or higher.

In order to provide the shell mold with the desired high refractoriness, it is preferable to form the mold of alumina. The preferred shell mold comprises at least 85 percent and more preferably 95 to 99 percent or more by weight of alumina and has a refractoriness such that the shell mold retains its shape at a temperature of 1650° to 1750° C. Methods of making such high-alumina molds are known in the art and form no part of this invention.

The alumina shell mold described above may be used with cores of varying refractoriness made in accordance with this invention and are preferably used with silica cores having an ultimate use temperature in excess of 1600° C. For example, such alumina shell mold can be used in the D.S. process with a high-silica core having an ultimate use temperature of 1650° C. to 1680° C. or higher, and such mold and core can be preheated to a temperature of 1500° C. to 1600° C. for 10 to 20 minutes or so to provide the core with 80 to 100 percent of cristobalite before molten metal is allowed to flow around the core.

In such a D.S. process the metal pouring temperature can be 1650° to 1700° C. and the molten metal in the shell mold can be at temperatures in the range of 1600° to 1650° C. for 10 minutes or more during metal casting without seriously deforming the core. For example, when casting a superalloy in a vacuum furnace by such a D.S. process, portions of the superalloy in the upper portion of the shell mold may be maintained at least 100° Centigrade above the melting point or liquidus temperature of the superalloy for a period of 10 minutes or more during metal solidification as the chill plate is gradually lowered. A high vacuum such as 10 to 20 microns of mercury is preferably maintained during such solidification. The temperature of the molten metal surrounding the core can be at least 40° to 50° Centigrade above said liquidus temperature for 10 to 20 minutes or more. The high temperature gradient provides substantially better results when casting certain superalloys.

High casting temperatures can also be very important when casting special superalloys which melt at very high temperatures. The present invention makes it possible to employ casting temperatures much higher than could previously be employed.

The process of the present invention is illustrated by a number of examples below for purposes of illustration rather than limitation, it being understood that the compositions, procedures, temperature conditions, and types of binder systems can be varied. Broadly, when carrying out the invention, a batch is compounded containing fused silica particles and an effective amount of mineralizer. The batch is shaped into a preformed core body of the desired shape, and the shaped body is fired by heating at a high temperature, such as 500° to 1200° C. or higher, for a sufficient period of time, such as 1 to 12 hours depending on the temperature, to provide the desired degree of sintering and devitrification and to provide the core with adequate strength and a suitable porosity.

In the examples below, the mineralizer is a sodium-stabilized colloidal silica which provides devitrifying sodium ions concentrated near the surface of the silica particles, but it will be understood that many other materials also provide suitable cristobalite promoting mineralizers.

A colloidal silica which can be conveniently used in the practice of the present invention is sold commercially under DuPont's trade name "Ludox", Monsanto's trade name "Syton", or Nalco's trade name "Nalcoag". Such colloidal silica has an average particle size less than 1 micron and a solids content of from about 30 to about 40 percent by weight, and contains a predetermined amount of sodium which is closely controlled by the manufacturer. Such colloidal silica can be used as a fluid but is preferably dried to evaporate the water, which is the normal carrier, thereby providing a sodium source of known concentration. The dried sodium-stabilized colloidal silica can be dry blended with the fused silica particles of the core composition to assure thorough distribution even if a liquid vehicle is subsequently added to the mix prior to forming the core.

Preformed cores compounded in accordance with the present invention, and containing a sodium-stabilized colloidal silica or other mineralizer can be formed by any conventional molding method such as pressing, injection, transfer, gravity or slip casting, dip casting, drain casting, extruding, rolling, spraying, etc. The cores can be formed by injection molding in a conventional manner, for example using procedures of the general type disclosed in U.S. Pat. No. 3,769,044. A suitable composition for injection molding could, for example, be as indicated below:

| Core Formulation | Parts by Weight |
|---|---|
| Fused Silica (-200 Tyler mesh) | 64–70 |
| Organic Vehicle | 12–15 |

-continued

| Core Formulation | Parts by Weight |
|---|---|
| Organic Binder | 3–10 |
| High-Temperature Binder | 0–10 |
| Internal Lubricant | 3–5 |
| Dried Sodium-stabilized colloidal silica (sodium content 0.75 to 1.0% by weight | 3–7 |

When using an amount of organic binder in the above formulation of about 5 to 6 percent of the weight of the silica, there can be produced a fired core of adequate strength having a porosity of from about 30 to 35 volume percent, containing at least 40 percent by weight of cristobalite, containing at least 0.03 percent by weight of sodium ions, and capable of producing more than 80 percent by weight of cristobalite if subsequently heated for 15 minutes at 1400° C. Such core can be provided with a silica content of 99 to 99.5 percent or more and a very high ultimate use temperature, such as about 1650° C.

The injection molding procedure employed for making the core may be of a conventional type and the vehicle, binder, and lubricant may be of a conventional type as disclosed, for example, in U.S. Pat. No. 3,549,736 or U.S. Pat. No. 3,769,044. It is preferable to employ a non-metallic compound such as oleic acid or stearic acid as the lubricant rather than a metal stearate, but it will be understood that various stearates can be used such as n-butyl stearate, aluminum stearate, ammonium stearate, magnesium stearate, or the like.

The above core formulation can be modified by substituting about 10 to about 20 parts by weight of the sodium-stabilized colloidal silica sol for the 3 to 7 parts of dried colloidal silica. The mixing procedure would then be modified by mixing the colloidal silica sol with the fused silica particles and the organic binder in the sigma-arm blender, and drying these materials at a temperature such as 120° C., for up to several hours before the remaining ingredients are added. Otherwise, the procedure would be the same and the mixed core composition would be shaped in the injection molding machine, and thereafter fired in the same manner.

In the above core formulation the fused silica has a purity of at least 99.5 and preferably at least 99.75 percent by weight, and has a particle size such as to provide a fired core having a porosity of 20 to 40 volume percent. Such fused silica can contain less than 40 parts per million of alkali metal ions and less than 100 parts per million of alkaline earth metal ions.

The silica is amorphous but can contain a small percentage of crystalline silica. The average particle size can be from 30 to 60 microns or higher, and a minor amount, such as 15 to 20 percent or more, can have a particle size less than 325 Tyler mesh or less than 40 microns.

Mixtures of different silicas or silica-producing materials can be employed. The fused silica can, for example, comprise a mixture of 10 to 30 parts of −325 mesh particles with 40 to 50 parts of larger (−200, +325 mesh) particles or can contain substantial amounts, such as 4 to 20 parts by weight of a silica-producing binder, such as a silicone resin, a silicone oil or the like, which forms amorphous silica after firing of the core. Excellent results can also be obtained when 10 percent of the refractory particles are zircon particles.

In the above general core formulation, the sodium-stabilized colloidal silica can be dried in a conventional manner, but it preferably spray dried or freeze dried.

Examples of specific core compositions for use in the present invention are as follows:

| | Parts by Weight |
|---|---|
| Core Formulation#1 | |
| Fused Silica | 64.1 |
| Organic Vehicle | 13.0 |
| Organic Binder | 3.9 |
| High-Temprature Binder | 7.8 |
| Internal Lubricant | 4.6 |
| Dried Sodium-Stabilized Colloidal Silica (Dried DuPont "Ludox" HS-30 Sodium Content 0.87% by weight) | 6.6 |
| Core Formulation #2 | |
| Fused Silica | 70.4 |
| Organic Vehicle | 13.0 |
| Organic Binder | 3.9 |
| High-Temperature Binder | 7.8 |
| Internal Lubricant | 4.6 |
| Ground Sodium Silicate Glass, −325 mesh (20% $Na_2O$ - 80% $SiO_2$) | 0.3 |

The Formulations #1 and #2 were mixed in a conventional sigma-arm blender. It is preferable to blend the dry ingredients including the fused silica, the mineralizer, and sometimes the organic binder before adding the remaining components of the mix. The organic vehicle, the lubricant and the high-temperature binder, if any, may be thoroughly mixed in any suitable manner, such as in a fluid carrier or organic solvent, before being added to the said dry ingredients in said sigma-arm blender. Improved uniformity can also be obtained by heating the mixture in said sigma-arm blender.

Before and during injection molding the temperature of the mix is raised to a temperature of from about 65° to about 90° C. or higher to facilitate flow into the mold cavity. After the green core is removed from the mold, it is slowly heated up to about 500° to 600° C. to remove and decompose the organic components. The cores are then fired at a temperature above 1000° C. and preferably 1100° to 1200° C. for up to 3 hours to provide the necessary strength for subsequent handling and to convert 40 to 50 percent of the silica to cristobalite.

The physical properties of the samples prepared from Core Formulation #1 and Core Formulation #2 are listed below:

| | Core Formulation #1 | Core Formulation #2 |
|---|---|---|
| Porosity, volume percent | 31.2 | 32.4 |
| Specific Gravity, gm/cc | 2.25 | 2.24 |
| Bulk Density, gm/cc | 1.53 | 1.52 |
| Room Temp. Modulus of Rupture, psi | 970 | 995 |
| Percent Cristobalite | 42 | 36 |

Samples prepared from both formulations were reheated at 1375° C. for 15 minutes, approximating a typical preheat cycle used in directional solidification. The cristobalite content of the samples were redetermined after this thermal cycle. Samples from both formulations had cristobalite contents greater than 80% by weight after this simulated preheat treatment. Other samples made from these two formulations, after firing at 1100° to 1200° C., were rapidly heated to determine the temperature at which a sample supported vertically would deform under its own weight. With both formulations this temperature was found to be greater than 1650° C.

After a green core made from one of the above formulations has been fired as indicated above, it can be positioned in the injection die of a wax injection machine, and molten wax can be injected around the core to form a disposable pattern. Thereafter, the pattern and core can be repeatedly dipped in ceramic slurry and dried in drying tunnels as disclosed in U.S. Pat. No. 2,392,864 to produce a multilayer shell mold surrounding the pattern.

The dried shell mold may be dewaxed in any suitable manner, as by placing it in a furnace at a high temperature, such as 800° to 1000° C., and may then be fired with the core for 10 minutes to one hour at a temperature of 850° to 1100° C. After firing they are cooled to room temperature and stored until use.

If the mold and core are to be used for directional solidification casting of nickel-base or cobalt-base superalloys, they are preferably preheated on a chill plate in a vacuum furnace prior to metal pouring. For example, the shell mold and core may be preheated for about 15 minutes in such a vacuum furnace having a furnace temperature of around 1480° to 1500° C., to preheat the core to a temperature of about 1380° to 1400° C., and to convert at least 75 percent of the silica to cristobalite before metal pouring is initiated. The molten superalloy can be poured at a temperature of 1620° C. or higher without causing serious slumping or distortion of the cristobalite core because the core can retain its rigidity at temperatures in excess of 1650° C. This is not true of conventional high-silica cores made prior to this invention which slumped at temperatures below 1600° C.

After the metal is poured into the shell mold and around the core, the metal begins to solidify at the chill plate and the metal temperature is lowered as the chill plate is gradually lowered in a direction away from the induction heating zone of the furnace. This causes the metal to solidify progressively over a period of about 1 hour until solidification is completed.

The mold is then removed from the furnace, the outer shell is broken away from the metal casting, and the casting is leached in molten caustic or caustic solution to remove the core.

The procedure used in the vacuum directional solidification process described above may be conventional, except for the novel core composition. The core of this invention is ideal for such a process because of its high refractoriness and produces castings of excellent quality.

The above core formulation can provide the core of the present invention with an ultimate use temperature from about 1650° to 1680° C. or higher, depending on the particular compounds employed therein. If the internal lubricant or mold release agent is oleic acid, stearic acid or other material which does not seriously reduce the refractoriness, then the core can have an extremely high ultimate use temperature. However, if the lubricant is a metal stearate the ultimate use temperature will be less.

The ultimate use temperature will depend on the materials mixed with the fused silica particles to form the core composition and the amounts thereof. A very high ultimate use temperature can be achieved using a sodium-stabilized colloidal silica or other finely divided silica as the mineralizer and using high-purity silica particles as the refractory material.

Good results can be obtained using other mineralizers, such as alkali metal silicates. For example, the colloidal silica in the above core formulation can be replaced by an amount of a sodium silicate in the range of about 0.5 to about 2 percent of the weight of the refractory particles where the silicate contains 20 percent or more by weight of sodium oxide.

The term "parts" means parts by weight and all percentages can be taken as percentages by weight, unless the context shows otherwise. The porosity of the core is set forth as volume percent.

It will be understood that, in accordance with the provisions of the patent laws, variations and modifications of the specific compositions, products and processes disclosed herein may be made without departing from the spirit of the invention.

We claim:

1. In a directional solidification casting process for precision casting of superalloys wherein a molten metal alloy at a temperature above 1500° C. is caused to flow into a preheated multi-layer refractory shell mold containing a preformed porous leachable vitreous silica core body and is caused to solidify progressively from the bottom of the mold over a period of time, said shell mold and said core body being preheated to a temperature of from 1300° to 1600° C., the improvement which comprises providing the preformed core body with a mineralizer containing devitrifying metallic ions which promote formation of cristobalite, a silica content of at least 90 percent by weight, and a limited amount of impurities so that the core body retains rigidity at high temperatures in excess of 1600° C. and converting at least 80 percent of the silica of said body to cristobalite before the molten metal is allowed to flow into the shell mold, the preformed core body containing from 35 to 55 percent by weight of cristobalite before being located in said shell mold.

2. In a directional solidification process for casting nickel-base and cobalt-base superalloys wherein a preformed vitreous silica core is located within an outer refractory shell mold to define an open-ended mold cavity of a predetermined size and shape, the mold and core are supported on a chill plate at the bottom of said cavity and preheated to a temperature of at least 1300° C. for up to 30 minutes in a furnace, a molten superalloy is introduced into the mold cavity around said core at a temperature of at least 1500° C. to fill the mold cavity, said chill plate causing the metal to solidify progressively from the bottom of the mold as the metal temperature is gradually reduced, and maintaining the temperature of the molten metal above 1400° C. in the upper portions of the mold cavity for at least 30 minutes during the metal solidification while maintaining a high vacuum in the furnace, the improvement which comprises forming said core of a refractory composition containing finely divided refractory particles and an organic binder, said refractory particles comprising at least 95 percent by weight of silica, less than 2 percent by weight of alumina and up to 5 percent by weight of zircon or zirconia, firing the shaped core at a temperature of from 1000° C. to 1600° C. for a period of time sufficient to convert at least 35 percent by weight of the silica to cristobalite, cooling the fired core to a temperature below 100° C., and thereafter preheating the core in said mold to a temperature from 1300° C. to 1600° C. for up to 30 minutes to convert at least 80 percent by weight of the silica to cristobalite before the molten metal is allowed to flow into the preheated mold, said refractory particles being of high purity and essentially free of metals which damage the casting and containing a limited amount of devitrifying metallic ions such that the core has high refractoriness and will retain rigidity at a temperature of 1650° C.

3. In a directional solidification process for precision casting of nickel-base and cobalt-base superalloys wherein a preformed porous leachable silica core is located within a multi-layer refractory shell mold to define an open-ended mold cavity of a predetermined size and shape, the shell mold and core are supported on a chill plate at the bottom of said cavity and preheated to a temperature of at least 1400° C. for up to one hour in a furnace, a molten superalloy is introduced into the mold cavity around said core at a temperature of at least 1500° C. to fill the mold cavity, said chill plate causing the metal to solidify progressively from the bottom of the mold as the metal temperature is gradually reduced, and the temperature of the molten metal is maintained above 1400° C. in the upper portions of the mold cavity for at least ½ hour during the metal solidification, the improvement which comprises forming said core of a refractory composition containing finely divided refractory particles, an organic binder and a mineralizer, said refractory particles comprising at least 95 percent by weight of silica, said mineralizer containing substantial amounts of devitrifying metallic ions which promote the formation of cristobalite, firing the shaped core at a temperature of from 1000° C. to 1600° C. for a period of time sufficient to convert from 35 to 50 percent by weight of the silica to cristobalite, cooling the fired core to a temperature below 100° C., forming a destructible pattern around the core, repeatedly coating the pattern and core with refractory material to form a multi-layer shell mold, removing the pattern and firing the mold and the core therein to a temperature from 800° to 1100° C. to strengthen the mold, cooling the fired shell mold and the core below 100° C., and thereafter preheating the core in the shell mold to a temperature from 1300° C. to 1600° C. for up to 1 hour to convert at least 80 percent by weight of the silica to cristobalite before the molten metal is allowed to flow into the preheated mold, said refractory particles being of high purity and containing a limited amount of devitrifying metallic ions such that the core has high refractoriness and will retain rigidity at a temperature of 1650° C.

4. In a process for precision casting of superalloys wherein a preformed porous refractory core formed of vitreous silica particles is located within a thin-wall refractory shell mold to define a mold cavity, the shell mold and core are preheated to a temperature from 1300° to 1600° C. for a period of time, and a molten superalloy is thereafter allowed to flow around said core and to solidify in said mold cavity, the improvement which comprises forming said core of a refractory composition containing finely divided refractory particles, a binder and a mineralizer, said refractory particles comprising at least 90 percent by weight of silica, said mineralizer containing substantial amounts of devitrifying metallic ions which promote conversion of the vitreous silica to cristobalite, firing the shaped core at a temperature of at least 1000° C. for a period of at least ½ hour to remove combustibles and to strengthen the core while effecting extensive devitrification to convert up to half of the silica to cristobalite cooling the fired devitrified core to a temperature below 200° C. and below the alpha-beta inversion temperature of the cristobalite, forming a destructible pattern around the core, covering the pattern and core with refractory material to form a thin-wall shell mold, removing the pattern material from the mold cavity, firing the mold and the devitrified core therein to strengthen the mold and then cooling the fired shell mold and the core therein below said inversion temperature, and thereafter preheating the core in the shell mold to a temperature of at least 1300° C. for a period of time such that at least 75 percent by weight of the silica of the core is crystalline silica before the molten metal is allowed to flow around said core, whereby the core retains rigidity in contact with said molten superalloy, said core containing an amount of devitrifying metallic ions greater than 0.02 percent of the weight of the core and such that preheating of the core for ½ hour at a temperature of 1400° C. will convert at least 60 percent by weight of silica to cristobalite.

5. The process of claim 4 wherein the core contains from 0.04 to 0.1 percent by weight of alkali metal ions.

6. The process of claim 4 wherein the core contains an amount of devitrifying metallic ions such that preheating of said core for up to ½ hour at a temperature of 1400° to 1500° C. will convert at least 75 percent by weight of the silica to cristobalite.

7. The process of claim 4 wherein said fired shell mold and the core therein are preheated for up to ½ hour at a temperature of from 1400° to 1600° C. to convert at least 80 percent by weight of the silica of the core to cristobalite before the molten metal flows around the core.

8. The process of claim 4 wherein said refractory particles contain no more than 5 percent by weight of refractories other than zircon, zirconia and silica and have a high purity such that the core has high refractoriness and will retain rigidity at a temperature in excess of 1600° C.

9. The process fo claim 4 wherein the core is preheated to provide at least 75 percent by weight of cristobalite before said molten superalloy is allowed to flow around the core, and wherein at least 35 percent of said cristobalite is formed in said fired core before such preheat.

10. The process of claim 4 wherein said core contains no more than 5 percent by weight of refractories other than zircon, zirconia and silica and has an ultimate use temperature in excess of 1600° F. and wherein portions of the molten superalloy surrounding the core during metal casting are maintained at a temperature of from 1600° to 1700° C. for at least 10 minutes during metal solidification.

11. The process of claim 4 wherein a molten nickel-base or cobalt-base superalloy at a temperature of at least 1550° C. is allowed to flow around the preheated core during casting, and said fired devitrified core contains an amount of said devitrifying metallic ions and an amount of cristobalite such that the preheating of the fired core for up to ½ hour enables the core to resist deformation during such casting.

12. A precision porous leachable refractory core for hightemperature precision investment shell mold casting of aircraft turbine engine airfoils from superalloys comprising at least 95 percent by weight of silica and no more than 55 percent by weight of cristobalite, said core containing at least 35 percent by weight of cristobalite and from 0.04 to 0.2 percent by weight of alkali metal ions that promote the formation of cristobalite, said alkali metal ions being present in an amount such that preheating of said core for ½ hour at a temperature of about 1400° C. will convert at least 60 percent by weight of the silica to cristobalite, said core being formed from a refractory composition containing finely divided refractory particles and a binder, said refractory particles comprising at least 75 percent by weight of high-purity silica particles with a purity of at least 99.5 percent by weight and up to 25 percent by weight of added mineralizer particles with a particle size not in excess of 50 microns containing at least 0.2 percent by weight of alkali metal ions, said mineralizer particles being treated with a sodium compound to provide said devitrifying metallic ions and to cause sodium ions to be concentrated at the outer surfaces of said mineralizer particles, the percentage by weight of said metallic ions in said mineralizer particles being at least several times that in said high-purity vitreous silica particles, said core having a modulus of rupture of at least 700 pounds per square inch and a porosity of from 20 to 40 volume percent.

* * * * *